US005927096A

United States Patent [19]

Piccione

[11] Patent Number: 5,927,096

[45] Date of Patent: Jul. 27, 1999

[54] AIR CONDITIONING SYSTEM AND METHOD

[76] Inventor: David O. Piccione, 5818 Valley Fair, Kingwood, Tex. 77339

[21] Appl. No.: 08/922,668

[22] Filed: Sep. 3, 1997

[51] Int. Cl.[6] ..... F25D 19/00

[52] U.S. Cl. ..... 62/298; 165/76

[58] Field of Search ..... 62/298; 165/76

[56] References Cited

U.S. PATENT DOCUMENTS

| | | | |
|---|---|---|---|
| 3,866,950 | 2/1975 | Skoch et al. | 285/4 |
| 4,027,498 | 6/1977 | Fessler | 62/263 |
| 4,088,466 | 5/1978 | Humprey et al. | 62/286 |
| 4,129,013 | 12/1978 | Hine, Jr. | 165/76 |
| 4,300,623 | 11/1981 | Meckler | 165/16 |
| 4,549,405 | 10/1985 | Anderson et al. | 62/298 |
| 4,633,766 | 1/1987 | Nation et al. | 98/1 |
| 4,698,982 | 10/1987 | Laios et al. | 165/76 |
| 4,848,214 | 7/1989 | Nagao et al. | 98/31.6 |
| 5,062,280 | 11/1991 | Martin | 62/291 |
| 5,277,036 | 1/1994 | Dieckmann et al. | 62/298 |
| 5,284,027 | 2/1994 | Martin, Sr. | 62/298 |
| 5,444,990 | 8/1995 | McGill, III et al. | 62/298 |

OTHER PUBLICATIONS

"ASFM Series: Horizontal Evaporator Coil", brochure (no date) produced by Allstyle Coil Co., Inc., 7037 Brittmore, Houston, TX 77041, Tel: (713) 466–6333.

*Primary Examiner*—William E. Tapolcai
*Attorney, Agent, or Firm*—Kenneth L. Nash

[57] ABSTRACT

Air conditioning apparatus and method are disclosed which provide for a bi-flow coil housing having air flow connection ends that are substantially identical. These coil housing features allow the coil housing to be configured to have either a right-hand or left-hand coil configuration to thereby allow installation flexibility so that the coil refrigerant and drain connections are readily available. In furtherance of this feature, a transition member and a plenum have substantially similar or identical ends for connection to the coil housing and may be connected to either end of the coil housing. Because there is only one end of the transition member that will vary in size thereby greatly reducing the number of different possible combinations of connection sizes the transition member must accord, a plurality of prefabricated transition members are preferably stored in the warehouse based on the type of heater. The use of a prefabricated transition member specifically designed for the specific type of heater and coil housing provides a quicker and precision fit therebetween.

21 Claims, 2 Drawing Sheets

10
26
13
12
28

10
13
12
26
20
28
24
16

10
12
26
24
13
14
20
22
16
18

30
16
18
32
13
10

AIR CONDITIONING SYSTEM AND METHOD

BACKGROUND OF THE INVENTION

1. Field of the Invention

The present invention relates generally to air conditioning systems and, more particularly, to systems and methods that not only facilitate more efficient air conditioning installation, but also improve system component storage and transport.

2. Description of the Background

Air conditioning systems normally include components such as an evaporator coil unit, a furnace, and a plenum. Various installation problems presently exist that increase time, cost, and quality of the system installation.

Conventional air conditioning systems typically require an air flow connection between the air conditioning coil housing and a furnace that normally includes the blower. A prefabricated transition member to make this connection is desired because of the speed and accuracy of the fit. However, because hundreds of different coil housings and furnaces or blowers are encountered, it is difficult to provide a prefabricated transition member to make this connection due to the large warehouse logistic problems and costs that would be associated therewith. A custom built transition member is therefore normally necessary to make this connection. In fact, it is somewhat unusual to have a factory manufactured direct connection these two very basic air conditioning system components. This practice results in increased material and labor costs and can possibly result in a less than perfect connection between units.

In the past, adjustable adaptors have also been used to provide the transition members that may adjustably adapt to many different types of equipment. In some cases, adjustable adaptors may have only a coarse adjustment range and therefore may not allow for the desired precision fit for all the different heater/blower units to avoid air flow blockage within the air flow passage or air leakage therefrom.

The coil housing normally connects to a plenum box from which conduits carry the air to the various desired locations in the air conditioned building for the air vents. Combined coil housing/plenums have been used to help solve the transition problem. However, the coil housing/plenum system produces a large, bulky system component that is harder to manipulate, install, transport and store. This bulkier system may also have difficult component orientation problems as discussed below, depending on the size and shape of the room, attic, nook, or the like in which the air conditioning system is situated.

In installing an air conditioning system, there is often a problem with positioning of the coil housing due to the particular orientation of the coil service connections and water drain pipe connections for the coil housing. In some cases, where the air conditioning system is to be placed in a large room, the coil orientation may not matter. In other installations due to the size of the room of the installation, if the coil configuration is not correct for the unit available at the location, then it becomes necessary for the installer to return to the base and pick up a differently oriented coil configuration housing so as to be able to make a connection to the coil without unreasonable difficulty. Coil configurations are sometimes referred to as right-hand or left-hand coil configurations depending upon the side from which the coil service connections are readily available. When the air conditioning system units are installed in attics or other building enclosures, the installer will not always know whether to bring a right-hand or left-hand coil configuration housing. The coil configuration problem, of course, increases labor and transport costs as well as warehouse costs. The warehouse costs arise due to the need to keep both types of coil configurations in stock.

Various inventors have recognized the above or related problems and attempted to resolve them as follows:

U.S. Pat. No. 5,062,280, issued Nov. 5, 1991, to L. Martin, discloses an air conditioning apparatus with an enclosure which both houses a conditioning coil and serves as a plenum for transferring air to one or more conduits. In one aspect, vanes of the coil or coils are oriented to direct air toward openings in the plenum. An enclosure is provided that serves as a coil housing and as a plenum.

U.S. Pat. No. 4,633,766, issued Jan. 6, 1987, to Nation et al., discloses an adaptor which is employed to join a heater and an air conditioning evaporator in an air conditioning system. The adapter is proved with a series of slidable panels which permit the adaptor to be sized to fit a particular heater by breaking off selected segments of the panes along a series of frangible connections.

U.S. Pat. No. 3,866,950, issued Feb. 18, 1975, to Skoch et al., discloses a multi-size adaptor to be connected to a duct in an air conditioning system and having a box like air discharge outlet in which an air diffuser can be mounted, and having an air inlet made in stepped sections of different size for enabling the same to be connected to one of several sizes of ducts to suit installation requirements. A modified embodiment includes a bellows section that can be axially compressed or flexed so as to be connected to a duct at an angle to the outlet.

U.S. Pat. No. 4,848,214, issued Jul. 18, 1989, to Nagao et al., discloses a supply and return air plenum unit for duct air-conditioning systems and includes a return air inlet and a supply air outlet defined in a case in a vertical juxtaposition, the supply air outlet having an opening located at a front lower comer of the case. A blow-off grill is disposed in the opening of the supply air outlet and is angularly moved by an actuator for varying the direction of the supply air within a range between the vertical and the horizontal.

U.S. Pat. No. 4,300,623, issued Nov. 17, 1981, to M. Meckler, discloses a multi- duct air conditioning system integrating ventilating, humidity control, filtering, chilling and heating, and distribution of liquids, embodied in a combination of means operating at peak efficiency under varied conditions, characterized by features such as a dual-stage refrigeration heat-pump apparatus with separate condensing of refrigerant subsequently commingled and expanded in a single evaporator supplying chilled water.

U.S. Pat. No. 4,088,466, issued May 9, 1978, to Humphrey et al., discloses an air conditioning unit with a refrigerant evaporator diagonally disposed within the air conditioning cabinet and includes a condensate drain trough at the opposite edges of the evaporator adjacent the front and rear wall of the cabinet, a drain pan assembly extending along the rear wall of the cabinet, and a detachable drip tray.

U.S. Pat. No. 4,027,498, issued Jun. 7, 1977, to H. S. Fessler, discloses an air conditioner for being mounted to the wall of an enclosure box having a cabinet, a refrigeration chassis mounted in the cabinet, and an L-shaped frame attached to and dividing the cabinet into first and second chambers, with a compressor and a condenser in the first chamber and an evaporator in the second chamber.

A review of the art discussed above reveals there is a need for an air conditioning installation system that allows for a precision fit, prefabricated transition member for use in making interconnections between the components of an air conditioning system in a quick, timely manner without the need for fabricating transition members on location, or for using multiple purpose transition members that may not fit as accurately as desired and still require additional time to adjust. The transition members should be readily storable to reduce capital expenditures such as inventory costs, warehouse space, as well as personnel costs including organization and maintenance of the inventory system. As well, a need exists for avoiding the problem installing a system in a small service room where coil evaporator lines and drain lines may be highly difficult to connect and therefore require changing out from a right-hand to left-hand coil unit or visa versa. Those skilled in the art have long sought and will appreciate the present invention which provides solutions to these and other problems.

SUMMARY OF THE INVENTION

The present system provides a unique apparatus and method for an air conditioning system that limits the number of possible transition members required for combining the basic components of the air conditioning system. This allows for relatively inexpensive storage of transition members. As well, the present invention also provides a more generic air conditioning coil enclosure that is usable either as a right-hand coil configuration or as a left-hand coil configuration. Since information relating to whether a right-hand or left-hand coil configuration is often not available to the installer prior to traveling to location, the more generic air conditioning coil enclosure and associated procedures eliminates the need for the installer to return to the warehouse for the necessary coil configuration evaporator.

Therefore, a system is provided for an evaporator that may be used with a furnace and blower that comprises an enclosure having an evaporator coil therein. The enclosure has first and second openings and defines an air flow path into the enclosure through the evaporator coil and out of the enclosure. The first and second openings define an input and output of the air flow path such that the evaporator coil is disposed between the first and second openings along the air flow path. The evaporator coil is suitable for two way air flow through the enclosure such that either of the first or second openings may be an air flow path input to the enclosure or an air flow path output from the enclosure. The first and second openings may preferably be substantially identical in size and shape. The enclosure has a wall to serve as service wall, and coil connections for the evaporator coil are provided at the service wall. The preferably substantially identical first and second openings allow rotation of the service wall of the enclosure during installation to a selectable desired position.

A preferred embodiment of the system includes an adaptor for connecting between the enclosure and the furnace. A plenum is also provided for connection to the enclosure. The adaptor and the plenum are sized to mate to either of the first and second openings. Thus, the plenum also has an opening sized to mate to either of the first or second openings of the enclosure.

Therefore, for warehouse purposes, a plurality of prefabricated adaptors are provided for connecting between the evaporator and the furnace. Each of the prefabricated adaptors is prefabricated to mate to the first and second openings of the enclosure. Each of the prefabricated adaptors is prefabricated to mate to a specific type of the furnace.

Stated differently, a coil housing is provided that has first and second substantially duplicate openings and defines an air flow path therethrough. A coil is mounted within the coil housing between the first and second substantially duplicate openings and is positioned along the air flow path. The installation system includes a plurality of prefabricated adaptors for connecting between the coil housing and one of a plurality of different air passageway openings that are associated with various heater/blower units. Each of the plurality of prefabricated adaptors is prefabricated to mate to either of the first and second substantially duplicate openings of the coil housing. As well, each of the prefabricated adaptors is prefabricated to mate to one of the the plurality of different air passageway openings found on the various heater/blower units.

The present invention includes a method for installing a coil housing, comprising steps such as positioning the coil housing having a coil therein adjacent a furnace unit. It is determined which of the two substantially identical openings of the coil housing are preferably connected to the furnace based on a position of tubular connections to the coil. A preferred of the two substantially identical openings is connected to the furnace unit, and a remaining of the two substantially identical openings is connected to a plenum. The position of the coil housing is thus determined based on which position of the coil housing provides better access to the tubular connections to the coil. The method further includes connecting a prefabricated adaptor between the coil housing and the furnace unit. Preferably the method includes storing a plurality of prefabricated adaptors all of which have a first side adapted to the coil housing which side is the same for all of the prefabricated adaptors. The prefabricated adaptors having a second side adapted to a particular furnace unit and which respective second side varies in dimension. The adaptor is selected for installing the coil housing by determining a type of the particular furnace unit. In the preferred embodiment shown, the coil housing is positioned such that air flow through the coil housing is directed substantially horizontally. However, the same principle of operation would apply to vertically oriented systems and so the invention also is intended to cover those systems as well.

The method includes selectively using the coil housing as either a right-hand or left-hand coil housing. A plenum is provided with an identical connection for the coil housing as found on each of the plurality of adaptors so that a step is included of interchangeably connecting the plenum and the adaptor to one of two substantially identical openings of coil housing based on a position of connections to a coil within said coil housing.

It is an object of the present invention to provide an improved air conditioning system and method.

It is another object of the present invention to provide an air conditioning system that allows use of a precision fit prefabricated transition member to connect between system components.

It is yet another object of the present invention to avoid the need for using a general purpose adjustable adaptor, that may not fit precisely and is not prefabricated for optimum air flow and sealing.

It is yet another object of the present invention to avoid the need to manufacture an adaptor on location.

It is yet another object of the present invention to provide a coil evaporator housing that can be used in either a right-hand coil configuration or left-hand coil configuration.

A feature of the present invention is identical flow openings on either side of the coil configuration.

Another feature of the present invention is a prefabricated transition member that varies only due to the heater manufacturer.

An advantage of the present invention is the ability to interchange the prefabricated transition member connection to the coil housing with the plenum box connection.

These and other objects, features, and advantages of the present invention will become apparent from the drawings, the descriptions given herein, and the appended claims.

Figures 1, 2, 3, 4:
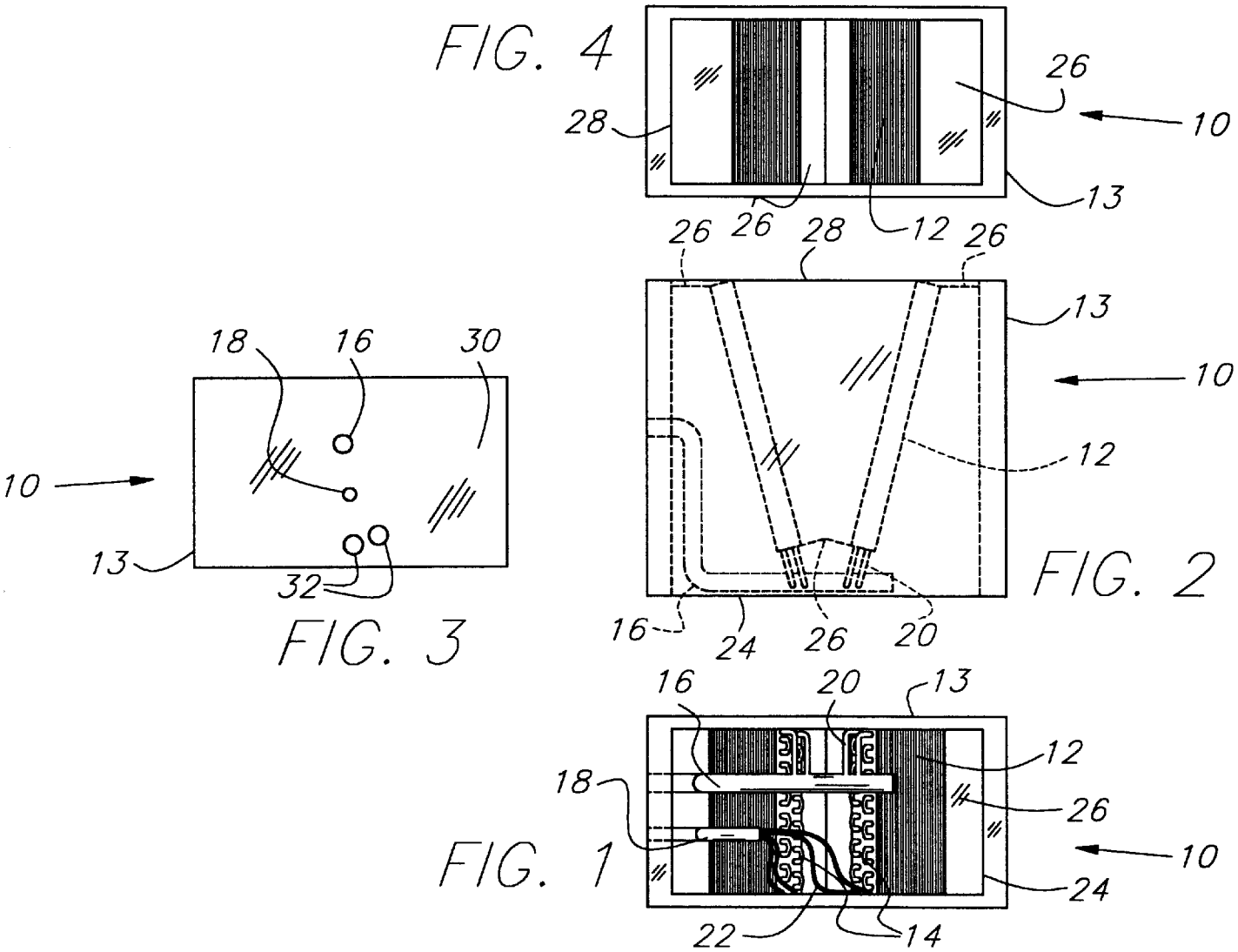
FIG. 1 is an elevational view, partially in section, showing a first air flow opening into a coil housing in accord with the present invention.
FIG. 2 is a top view, partially in section, showing the coil housing of FIG. 1.
FIG. 3 is an elevational view, showing the coil and drain connections for the coil housing of FIG. 1.
FIG. 4 is an elevational view, showing a second air flow opening into the coil housing of FIG. 1.
Figure 7:
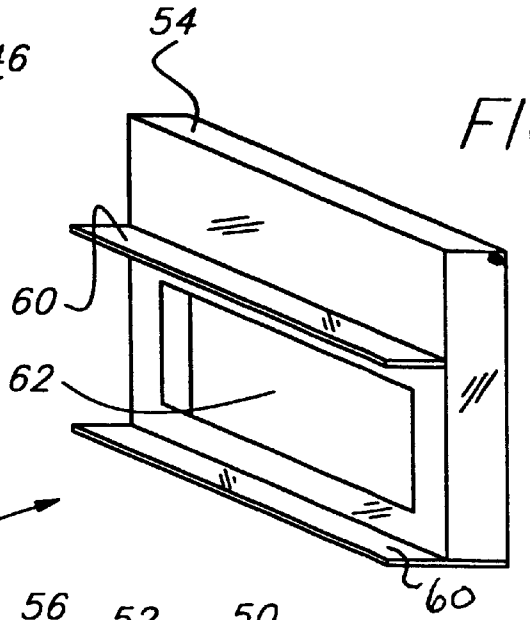
FIG. 7 is a perspective view of the prefabricated transition member of FIG. 6.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Referring now to the drawings, and more particularly to FIG. 1–4, the general layout of the coil housing 10, in accord with the present invention, is illustrated.

In FIG. 1, the coil 12 through which air flow proceeds to effect air conditioning, is shown secured within enclosure 13 and having various tube rows 14 disposed therein. For convenience especially in the claims section, the various components of coil 12 and associated tubing, connections, fins and other components as discussed hereinafter may be referred to as the "coil". Refrigerant connections 16 and 18 from the outdoor unit (not shown) are connected to the coil via connections 20 and 22, respectively, to return bends 14. Air flow may proceed through first opening 24 into or out of coil housing 10. Thus, first opening 24 may act as either an air flow input or output from enclosure 13.

FIG. 2 shows a top view wherein coil 12 is shown to be substantially V-shaped. Although this is the presently preferred embodiment of coil 12, other configurations known to those skilled in the art could also be utilized. Various coil front and rear support elements, panels or walls 26, as well as the walls or panels of enclosure 13, direct air flow into coil housing 10 through coil 12 prior to exiting coil housing 10. Coil 12 is designed as a bi-flow coil so that air may flow either way therethrough, for reasons discussed hereinafter. Therefore, second opening 28 may also act as either an air flow input or output from enclosure 13. Preferably, enclosure 13 is sized to fit closely to coil size height and width dimensions without unnecessary bulk to thereby reduce the size thereof to allow greater packing density thereby lowering shipping costs significantly as compared to bulkier units. The rectangular shape of enclosure 13 also aids in increasing packing density.

FIG. 3 discloses an opposite view into coil housing 10 as compared to the view of FIG. 1. It will be noted that an important feature of the present invention is that second opening 28 shown in FIG. 3 is identical, or substantially identical with minor differences due to tolerances, as that of first opening 24 shown in FIG. 1. Such tolerances are those that are normally encountered in air conditioning installation and may generally be in the range of less than about one quarter inch or so. Of course, the connection could be internal of opening 24 so that the size of opening 24 determines the fit and the size of enclosure 13 is not determinative of the fit and could vary in size or shape. Or, as is presently preferred, a slip fit is made to the outer diameter of enclosure 13 so that the size and shape of enclosure 13 are substantially determinative of the connection tolerances. In some cases, both tolerances may be desirably controlled for the fit or one or more size and shapes of input/output related features may be controlled. There are many advantages to having first opening 24 and second opening 28 being the same size, as discussed subsequently. In the present invention, first opening 24 is preferably on the opposite side of coil housing 10 from second opening 28 so that air flow is directed more or less straight through enclosure 13.

FIG. 4 shows a service panel side 30 with condensate drain connections 32, as well as coil connections 16 and 18. The connections may extend from the panel wall or be flush with it. It is possible to provide hinges, screws (presently preferred) or the like to gain access through service panel 30, if desired.

Figure 5:
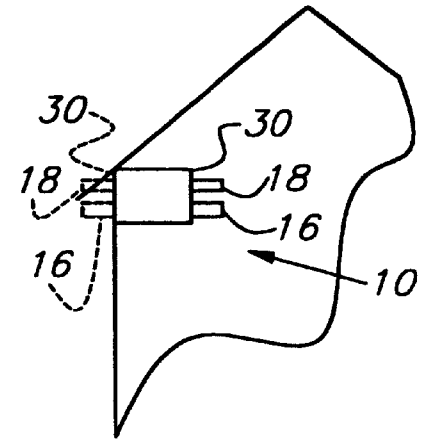
FIG. 5 is a schematical drawing that indicates the utility of a coil housing that may be used in a right-hand or left-hand coil orientation.

In FIG. 5, one of the advantages to having a bi-flow coil housing 10 with identical openings 24 and 28 is disclosed. When mounting the air conditioning system, the surroundings are often small and cramped. If service panel 30 with coil connections 16 and 18 are on the wrong side of coil housing 10 because of the heater connection and coil configuration (as indicated in dash line), connections 16 and 18 will be very difficult to reach and make suitable connection to. Normally when this occurs, it is necessary to return to the shop and obtain a coil housing with the opposite coil configuration, e.g., to replace a right-hand coil configured housing with a left-hand coil configured housing. With the bi-flow coil housing 10 of the present invention that has identical openings, it is possible to simply reverse the plenum and adaptor without having to turn the coil housing around from the desired position (as indicated in solid line). Thus, with the present invention, coil housing 10 can always be installed with service panel 30 and connections 16 and 18 in the most desirable position. The time/cost savings are substantial over a time period where numerous installations are made. This advantage will become more apparent as discussed in the context of the remainder of the air conditioning system. It will be noted that his feature also saves considerable warehouse costs because it is necessary to store only one type of coil housing 10 rather than a right-hand and left-hand coil configuration housings. Clearly, lost time is greatly reduced because the installer does not need to return to the shop if the coil configuration needs to be changed.

It will be noted that coil housing 10 has a substantially rectangular enclosure 13 that is sized to be just large enough for the coil elements. This small size and rectangular shape allow for easy packing of relatively larger quantities. Therefore, this design results in lower shipping costs of coil housing 10.

Figure 8:
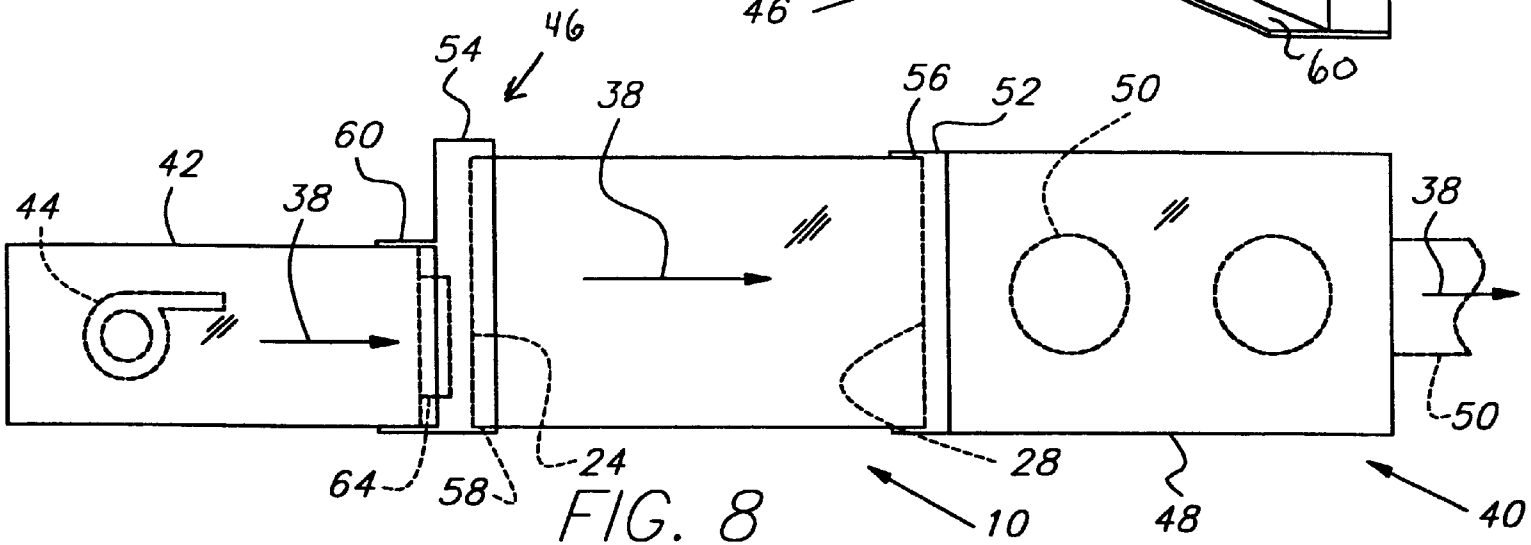
FIG. 8 is an elevational view of an air conditioning system in accord with the present invention.

In FIG. 8, the basic layout of horizontal air conditioning system 40 is disclosed. Although the present invention is disclosed in terms of a horizontal air conditioning system wherein air flow through system 40, as indicated by arrows 38, it will be apparent that the same invention is readily adaptable to a vertically oriented system. Heater unit 42 generally includes therein a blower 44. Coil housing 10 connects to heater unit 42 by means of an adaptor such as transition member 46. On the opposite side of coil housing 10 from transition member 46 is plenum 48. Plenum 48 serves to connect air flow to the various air ducts 50 that direct conditioned air throughout the building.

In accord with the present invention, plenum connection 52 with coil housing 10 is identical within size tolerances, as discussed above, to the transition member 46. In other words, transition member 46 and plenum 48 can swap between first and second identical openings 24 and 28 of coil housing 10. This feature allows for advantageous positioning of coil housing 10, as discussed above. Effectively, coil housing 10 may be considered to be a generic right-hand or left-hand coil configuration. While other types of connections could be used, a slip fit connection for the coil housing is presently preferred to allow maximum air flow with minimum blockage. Thus, each of lip 56 of plenum 48 and lip 58 of transition member 46 slip fit over either ends 24 and 28 of coil housing 10 in the presently preferred embodiment. In the present embodiment, lip 58 preferably extends completely around the entire perimeter of coil housing 10 to provide a complete slip fit. See discussion of lip 60 for other variations of lip seal slip fit. Other types of connections discussed above such as different types of receptacles, pin members, and the like could also be used to make a connection. Therefore for other types of connections, the outer size 54 of transition member 46 may be more narrowly specified.

Heater 42 may be of many different sizes so that connection lip 60 of transition member 46 is shown here for illustrative purposes only. Here lip 60 is found above and below heater 42 but could be made to go completely around the flange or perimeter thereof, if desired. The point is that a prefabricated adaptor can be designed and made precisely to fit in the best manner regardless of additional complexities of the best desired connection. General purpose or field fabricated adaptors are not of this same quality as it is difficult to design for every possibility and for all degrees of difference. Therefore, such adaptors will necessarily be less convenient and quick to install. For purposes of this application, a prefabricated adapter is therefore meant to include adaptors designed, made, and stored prior to installation for a particular furnace and coil evaporator unit. Moreover, because coil housing ends 24 and 28 are always the same size, it is only necessary that the adaptor connection to heater 42 vary in size. Thus, the possible number of different combinations of heaters and evaporator coil connections is greatly reduced. This reduction in the number of possible size connections allows transition members, such as members 46, to be stored in the warehouse according to the type of heater to which the connection is made. In this manner, a prefabricated transition member 46 can be used in putting together the air conditioning system. Use of a prefabricated transition member greatly speeds time of assembly of the system. As well, the connection is designed in advance to be the most advantageous type of fitting thereby providing superior air flow and minimum air leakage as compared to either individually location built transition members, and general purpose transition members. Less material is used in a prefabricated transition member thereby saving material costs. As well, the material can be shaped and wrought much better at a fabrication plant for a more perfect fit than can be accomplished in the field.

Figure 6:
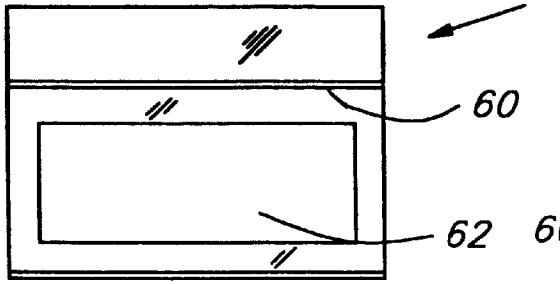
FIG. 6 is an elevational view of a prefabricated transition member in accord with the present invention.

FIG. 6 provides a front elevational view of adaptor or transition member 46. For illustrative purposes only in connecting to heater 42, FIG. 6 shows opening 62 that may be sized to mate to heater 42 whether heater 42 has generally a pin type connection as indicated at 64, or a receptacle type connection whereby lip 60 seals around the outer walls of heater 42, a combination receptacle/pin connection, or the like. Therefore a significant advantage of the system of the present invention is that it permits an inventory to be maintained with a plurality of transition members 46. Each transition member 46 has an end mated to coil housing 10 in a size that remains constant. The opposite end of transition member 46 may vary as to size and shape of opening 62, lip 60, or other in other manner as will depend upon the particular type or make of heater 42. The greatly reduced number of possible combinations of connections makes this realistically feasible. The result is greatly improved fittings as a result of prefabricated transition members that reduce material costs, reduce time of installation thereby reducing labor costs, and improve the quality of the connection. This feature in combination with the identical ends of bi-flow coil housing 10 make for a flexible installation system that can be made in a shorter time, warehoused at lower costs, that is easier to maintain, and results in an overall improved quality system.

The foregoing disclosure and description of the invention is illustrative and explanatory thereof, and it will appreciated by those skilled in the art, that various changes in the size, shape and materials as well as in the details of the illustrated construction or combinations of features of the various coring elements may be made without departing from the spirit of the invention.

What is claimed is:

1. A system usable with a horizontally oriented furnace and blower for air conditioning, said system being disposed downstream of air flow from said furnace, said system comprising:

an enclosure having an evaporator coil therein, said enclosure having first and second openings, said enclosure defining an air flow path into said enclosure through said evaporator coil and out of said enclosure wherein said first and second openings define an input and output of said air flow path such that said evaporator coil is disposed between said first and second openings along said air flow path, said evaporator coil being suitable for two way air flow through said enclosure such that either of said first or second openings may be an air flow path input to said enclosure, said first and second openings being substantially identical in size and shape, said enclosure having a wall to serve as service wall;

a plenum for conducting air flow from said furnace to a plurality of conduits, said plenum having an inlet aperture for connection to said enclosure, each of said first and second openings of said enclosure being sized for mating with said inlet aperture of said plenum such that said system is directly mountable with said plenum to either of said first and second openings; and coil connections for said evaporator coil at said service wall.

2. The system of claim 1, further comprising:

an adaptor for connecting between said enclosure and said furnace, said adaptor having two opposite ends with one end being sized for mating to either of said first and second openings, said opposite end of said adaptor being sized for connection to said furnace.

3. The system of claim 1, further comprising:

a plurality of prefabricated adaptors for connecting between said enclosure and said furnace, each of said prefabricated adaptors being prefabricated to mate to said first and second openings of said enclosure, each of said prefabricated adaptors being prefabricated to mate to a specific type of said furnace.

4. The system of claim 1, wherein said system is mountable in either a right hand horizontal or left hand horizontal position of said coil connections with respect to said plenum.

5. The system of claim 1, further comprising:

a slip fit interconnection between said inlet aperture and each of said first and second openings.

6. An air conditioning installation system for downstream connection to a furnace that is adaptable for connection to any of a plurality of different size air passageway openings in said furnace, said air conditioning installation system comprising:

a coil housing having first and second substantially duplicate openings and defining an air flow path therethrough, a coil mounted within said coil housing between said first and second substantially duplicate openings positioned along said air flow path; and a plurality of prefabricated adaptors for connecting between said coil housing and one of said plurality of different air passageway openings, each of said plurality of prefabricated adaptors being prefabricated to mate to said first and second substantially duplicate openings of said coil housing, each of said prefabricated adaptors being prefabricated to mate to a specific of said plurality of different air passageway openings.

7. The air conditioning system of claim 6, further comprising:

a slip fit connection between each of said first and second duplicate openings and each of said plurality of prefabricated adaptors.

8. The air conditioning system of claim 6, further comprising:

a plenum having an opening that mates with said first and second substantially duplicate openings of said coil housing.

9. A method for installing a coil housing downstream from a furnace, comprising:

positioning said coil housing having a coil therein adjacent said furnace unit;

determining which of two substantially identical openings of said coil housing are preferably connected to said furnace based on a position of tubular connections to said coil;

connecting a preferred of said two substantially identical openings with said furnace unit; and connecting a remaining of said two substantially identical openings to a plenum.

10. The method of claim 9, wherein said step of determining further comprises:

determining what position of said coil housing provides better access to said tubular connections to said coil.

11. The method of claim 9, further comprising:

connecting a prefabricated adaptor between said coil housing and said furnace unit.

12. The method of claim 9, further comprising:

storing a plurality of prefabricated adaptors all of which have a first side adapted to said coil housing which side is the same for all of said prefabricated adaptors, said prefabricated adaptors having a second side adapted to a particular furnace unit and which respective second side varies in dimension.

13. The method of claim 12, further comprising:

selecting an adaptor for installing said coil housing by determining a type of said particular furnace unit.

14. The method of claim 9, further comprising:

providing a slip fit connection between each of said two substantially identical openings and said plenum.

15. The method of claim 9, further comprising:

installing said coil housing such that air flow through said coil housing is directed substantially horizontally.

16. A method for installing a coil housing, comprising:

storing a plurality of prefabricated adaptors all of which have a first side adapted to a coil housing which side is the same for all of said prefabricated adaptors, said prefabricated adaptors having a second side adapted to fit to a particular furnace unit and which respective second side varies in dimension depending on a respective of said particular furnace unit; and selecting an adaptor for installing said coil housing by determining a type of said particular furnace unit alone without need for determining a type of said coil housing because all of said coil housings are substantially identical.

17. The method of claim 16, further comprising:

selecting use of said coil housing regardless of whether a right hand or left hand coil housing is required.

18. The method of claim 16, further comprising:

selectively using said coil housing as either a right hand or left hand coil housing.

19. The method of claim 16, further comprising:

providing a plenum having an identical connection for said coil housing as found on each of said plurality of adaptors.

20. The method of claim 19, further comprising:

interchangeably connecting said plenum and said adaptor to one of two substantially identical openings of said coil housing based on a position of connections to a coil within said coil housing.

21. The method of claim 16, further comprising:

providing a slip fit connection between each of said two substantially identical openings of said coil housing and said adaptor.

* * * * *